US005429291A

United States Patent [19]

Thompson

[11] Patent Number: 5,429,291

[45] Date of Patent: Jul. 4, 1995

[54] COMPRESSION ACTUATED TOOL FOR DRIVING FASTENERS

[76] Inventor: William J. Thompson, 2120 Mendocino St., Fullerton, Calif. 92631

[21] Appl. No.: 334,201

[22] Filed: Nov. 4, 1994

Related U.S. Application Data

[63] Continuation-in-part of Ser. No. 147,935, Nov. 5, 1993.

[51] Int. Cl.[6] ..... B25C 1/14

[52] U.S. Cl. ..... 227/10

[58] Field of Search ..... 227/9, 10, 11

[56] References Cited

U.S. PATENT DOCUMENTS

| | | | |
|---|---|---|---|
| 1,365,869 | 1/1921 | Temple . | |
| 1,365,870 | 1/1921 | Temple . | |
| 2,213,435 | 9/1940 | Temple, Jr. . | |
| 2,395,354 | 2/1946 | Temple . | |
| 2,479,431 | 8/1949 | Temple . | |
| 2,716,813 | 9/1955 | Smyres . | |
| 3,203,609 | 8/1965 | Diehl . | |
| 3,212,535 | 10/1965 | Broske . | |
| 3,235,154 | 2/1966 | Mulno . | |
| 3,297,224 | 1/1967 | Osborne . | |
| 3,468,466 | 9/1969 | Wackrow . | |
| 3,481,143 | 12/1969 | Hsu . | |
| 3,494,018 | 2/1970 | Helderman et al. . | |
| 3,540,141 | 11/1970 | Butler . | |
| 3,547,333 | 12/1970 | Helderman . | |
| 3,554,425 | 1/1971 | Oesterle . | |
| 3,589,584 | 6/1971 | Ohlsson . | |
| 3,665,583 | 5/1972 | Helderman | 227/10 |
| 3,678,808 | 7/1972 | Hsu et al. . | |
| 3,679,118 | 7/1972 | Maier et al. . | |
| 3,797,721 | 3/1974 | Clumb . | |
| 3,805,472 | 4/1974 | Helderman . | |
| 3,981,424 | 9/1976 | Maier . | |
| 4,074,843 | 2/1978 | Oesterle . | |
| 4,114,792 | 9/1978 | Pomeroy . | |
| 4,196,834 | 7/1980 | Beton . | |
| 4,201,324 | 5/1980 | Maier et al. . | |
| 4,358,041 | 11/1982 | Ollivier | 227/10 |
| 4,479,599 | 10/1984 | Conrad . | |
| 4,804,127 | 2/1989 | Kirkman . | |
| 4,883,211 | 11/1989 | Phillipp et al. . | |
| 4,899,919 | 2/1990 | Clumb . | |
| 5,016,802 | 5/1991 | Haytayan . | |
| 5,114,064 | 5/1992 | Jochum et al. | 227/10 |
| 5,135,150 | 8/1992 | Chun . | |
| 5,273,198 | 12/1993 | Popovich et al. | 227/10 |
| 5,363,736 | 11/1994 | Huang | 227/10 |

*Primary Examiner*—Scott A. Smith
*Attorney, Agent, or Firm*—Price, Gess & Ubell

[57] ABSTRACT

This invention relates to an impact actuated tool for driving a fastener by an explosive charge, particularly a tool having a housing with a barrel axially slidably mounted within the front end. A nosepiece is fixed to the front of the barrel with a muzzle at its front end for receiving a fastening element that is to be secured in a ceiling or the like. A piston is slidably mounted within the bore in the barrel. The barrel is biased forwardly in the firing direction. At the rear of the tool a handle engages a firing pin which is slidably mounted within the rear end of the bore. The firing pin is biased rearwardly towards the back end of the tool. One embodiment of the tool includes a ball lock safety device to allow discharge only when the muzzle of the tool is pointed in an upward direction. The tool is fired by impacting the nosepiece against a surface to effect displacement of the barrel and firing pin against their respective biasing springs.

25 Claims, 8 Drawing Sheets

COMPRESSION ACTUATED TOOL FOR DRIVING FASTENERS

This application is a continuation-in-part of U.S. patent Ser. No. 08/147,935, filed Nov. 5, 1993, pending.

BACKGROUND OF THE INVENTION

1. Field of the Invention

The present invention relates to an impact actuated tool for driving fasteners into work surfaces such as ceilings and the like and, more particularly, to a lightweight impact actuated tool that operates in a relatively silent, safe, and trouble-free manner.

2. Description of Related Art

A variety of explosive actuated tools for driving fasteners have been developed over the years. Such tools include those shown in U.S. Pat. Nos. 3,407,982; 3,665,583; 3,797,721; 3,805,472; 4,655,380, and the patents cited therein. However, the prior art explosive actuated driving tools suffer from several disadvantages and limitations. Generally, explosive actuated driving tools are relatively complex in construction and costly to manufacture. In addition, due to the placement of the venting mechanism of the combustion chamber, many of these tools suffer from the disadvantages that they are relatively noisy. Furthermore, the pistol type driving tools are heavy, cumbersome, and, because of the pistol-type trigger mechanisms, are not easily adapted to be mounted to a pole assembly for driving fasteners into overhead ceilings.

OBJECTS AND SUMMARY OF THE INVENTION

The present invention provides an improved impact actuated tool without a pistol-type trigger mechanism for driving a fastener into a work surface such as a ceiling or the like. The present invention further provides an impact actuated tool which is durable in use, yet is lightweight, compact, and easy to operate. In addition, the invention provides an impact actuated tool which is quiet in operation, yet provides driving forces superior to the prior art.

One significant advantage of the tool of the present invention is that it achieves an improvement in driving force because at the moment of actuation every element of the tool is in direct contact with every other element, and the momentum of the entire tool is in the direction in which the fastener is desired to go. As a result of the tool elements being in direct contact, substantially all of the explosive power of the cartridge is utilized to drive the fastener into the receiving substrate. Thus, superior driving force is achieved over much of the prior art which trades off driving power for versatility. For example, much of the prior art was designed for use as a general purpose tool with gap spaces between some of the elements of the tool so that the tool could accommodate fasteners with lengths between 1–3 inches. As a result, these prior art devices experienced a reduction in driving power since the explosive gases must expand into the gap area and compressive power is wasted in driving the elements through the gap lengths. In the present invention the explosive gases cannot escape or expand without performing the work of driving the piston forward.

Another means by which the tool achieves an improvement in driving force is by selective placement of the ports in the barrel. For example, for a standard $1\frac{1}{4}$-inch fastener, the high velocity gases are expanded into selectively located ports only after the fastener is completely driven into the workpiece. Thus, an improvement in driving force is achieved since there is no exit means for the expanding gases of the propellant and thus, no drop in the driving force being applied to the fastener until after the fastener is fully seated in the workpiece.

As discussed above, the prior art often traded driving power for versatility to permit fasteners of different lengths to be utilized with different propellant charges to penetrate different materials. As a result, these prior art devices experience a reduction in driving power, since the explosive gases begin to be vented as soon as the rear of the piston moves past a slotted aperture, thereby relieving the driving force on the fastener. In the present invention the explosive gases cannot escape the barrel bore without performing the work of driving the piston forward.

In a preferred embodiment, the invention is further provided with a safety device mounted to the rear of the housing. The device comprises a ball placed within a longitudinal internal groove with a shoulder within the safety device. The ball is sized to lodge between the shoulder and the wall of the groove to prevent axial movement of the handle when the muzzle of the tool is oriented in a downward direction.

An additional embodiment of the invention is particularly adapted to allow highly accurate placement of a fastener. Such accuracy is achieved since the user is able to place the fastener at the desired point and then continue to compress the tool until it fires. This ability is particularly beneficial when shooting fasteners into wood or a substrate covered with a layer of insulation.

Other objects and merits and a fuller understanding of the present invention will be obtained by those having ordinary skill in the art when the following detailed description of the preferred embodiment is read in conjunction with the accompanying drawings.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

Figure 8A:
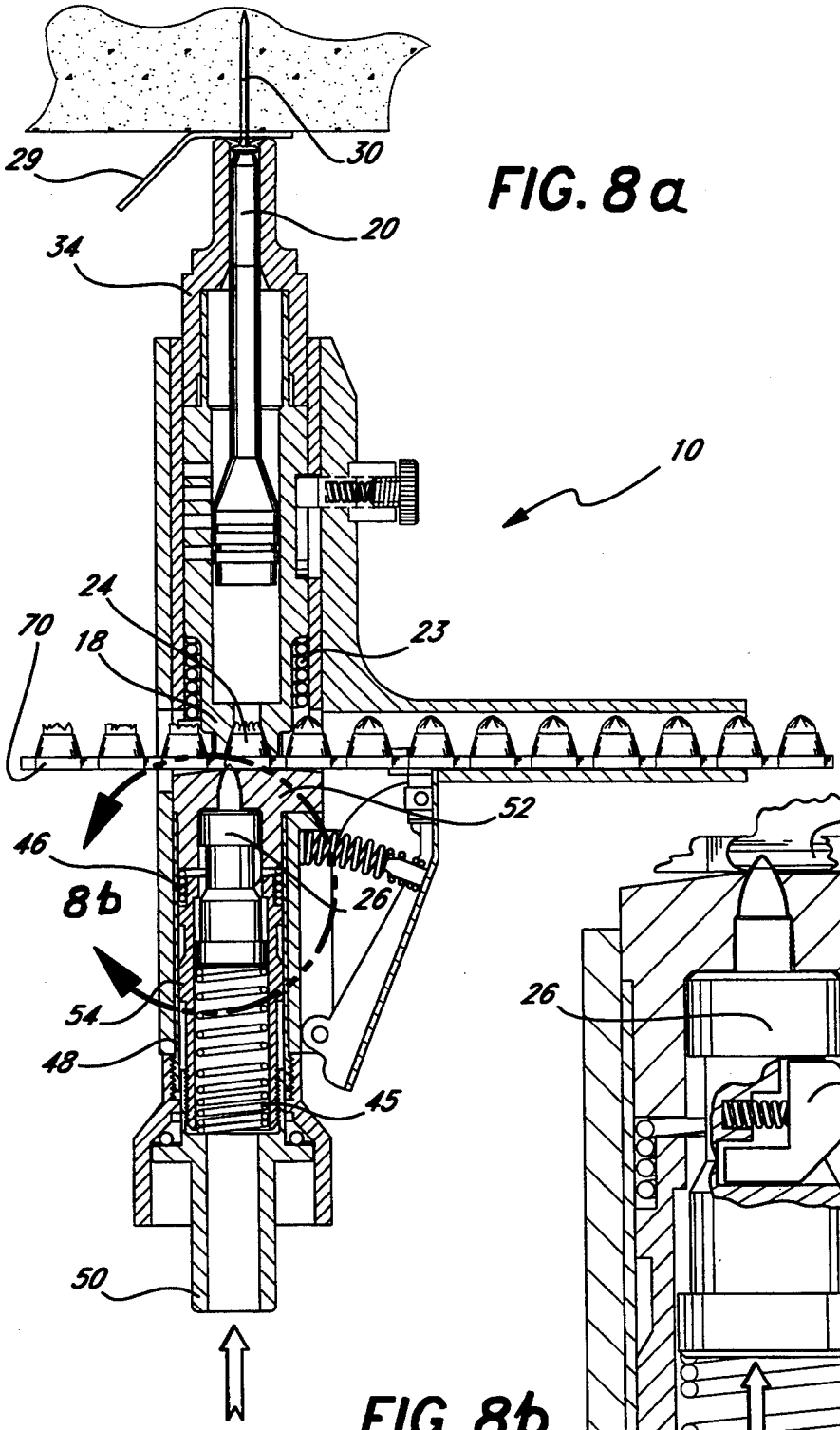
Figure 8B:
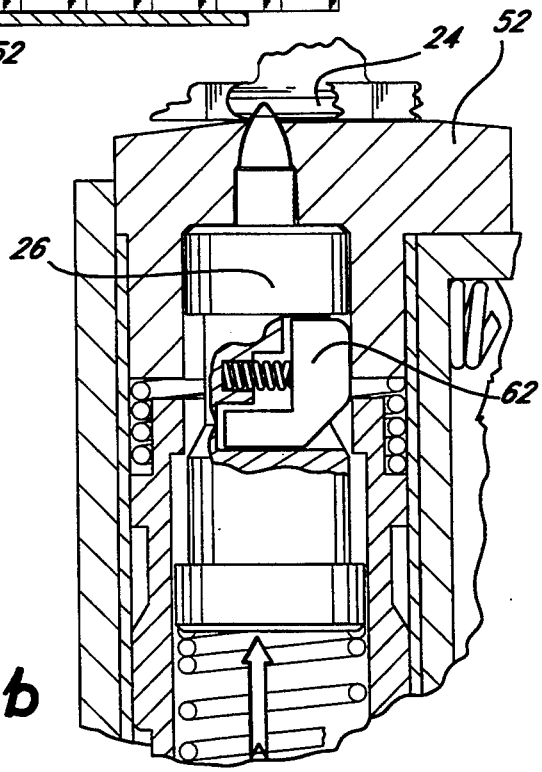

FIG. *7a* is a longitudinal sectional view of the third embodiment showing the second step in firing the tool;

FIG. *7b* is an enlarged sectional view of the firing mechanism during the second step just prior to firing;

FIG. 8*a* is a longitudinal sectional view of the third embodiment showing the third step in firing the tool; and FIG. 8*b* is an enlarged sectional view of the firing mechanism during the third step just after firing.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically.

Figure 1:
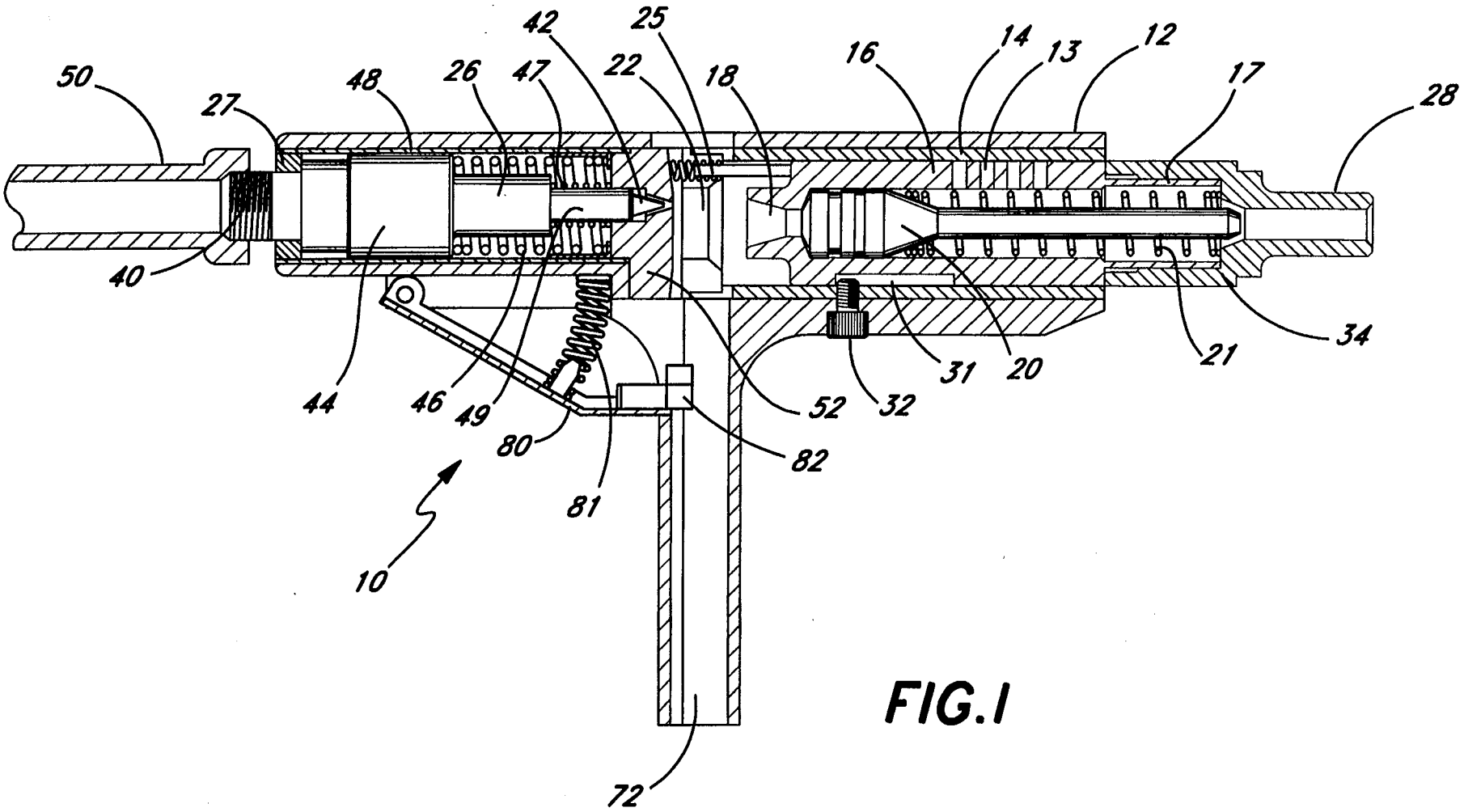
FIG. 1 is a longitudinal sectional view of a tool constructed in accordance with the invention.

Referring now to the drawings, particularly FIG. 1, there is shown an impact actuated tool 10 for driving fasteners embodying the present invention. Tool 10 is cylindrically-shaped and utilizes a powder load to actuate a piston 20 for driving forced entry fasteners into a hard receiving substrate such as precast materials, concrete, wood, metal decking with cement, or solid steel. Tool 10 has a long pole handle 50 that both operates as a slidable ram for firing an explosive charge and allows the operator to extend the tool body to the ceiling for the driving of overhead fasteners. The handle allows the operator to extend the tool to the desired substrate which is often located two to ten feet overhead from and out of reach of the operator of the tool. Inasmuch as the distance to the work surface varies with the job, handle 50 may come in different, fixed lengths or may be telescopic. The fastener 30 (FIG. 2) utilized by the tool may be one of the many fasteners well known in the art. Such fasteners typically have a head portion 30*a* and a body or shank portion 30*b*. Often, a plastic fluted centering member 30*c* is positioned around shank 30*b*, as is well known in the art. Often it is desired to attach an angled clip 29 to the workpiece. In such instances, clip 29 is simply friction fit to the protruding end of fastener 30. See FIGS. 2–3, 6, 7*a*, and 8*a*.

The impact actuated tool includes a housing 12 which has a bore extending through its entire length. Tool 10 has a front end spaced in the firing direction and a rear end in the opposite direction.

The front portion of the bore is lined with a tubular sleeve 14. A cylindrically-shaped barrel 16, having a central bore extending therethrough, is mounted within the front end of sleeve 14. Barrel 16 has a forward end in the firing direction and a rear end or breech 18 in the opposite direction. At the front end of barrel 16, the bore is sized to receive a piston 20. A firing chamber 22 is formed in housing 12 at the breech end 18, wherein the bore is configured to receive a percussion explodable charge or cartridge 24 which is detonated by a firing pin 26. Firing chamber 22 communicates with the barrel bore so that when cartridge 24 is exploded, fastener 30 positioned within the bore is driven from the muzzle of the tool.

Barrel 16 is mounted such that it can axially slide back and forth within sleeve 14. A slot 31 is formed on the outside of barrel 16. A screw 32 extends through housing 12 and sleeve 14 to engage slot 31 to constrain barrel 16 to limited longitudinal movement relative to the housing. A biasing means 25 urges barrel 16 forwardly in the firing direction. This biasing of the barrel serves the function of displacing barrel 16 such that another cartridge 24 can be indexed into position for firing. This biasing of the barrel also functions as a safety feature to prevent tool discharge, since tool 10 can not discharge unless barrel 16 is axially displaced against cartridge 24 in breech 18. The barrel displacement normally occurs when the tool is impacted against a ceiling.

Figure 2:
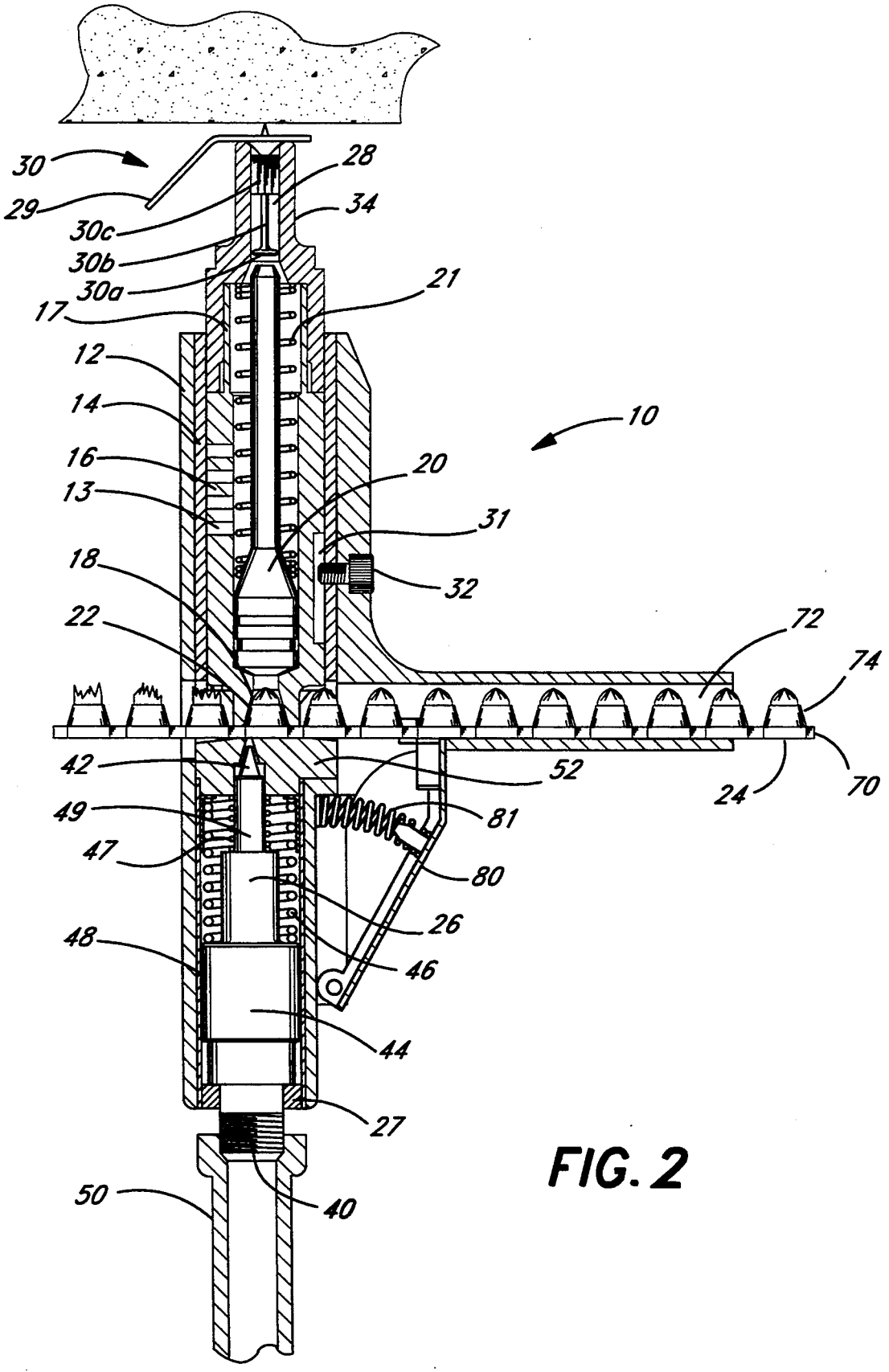
FIG. 2 is a longitudinal sectional view of the tool, loaded with a cartridge and ready to fire, just prior to being fired.
Figure 3:
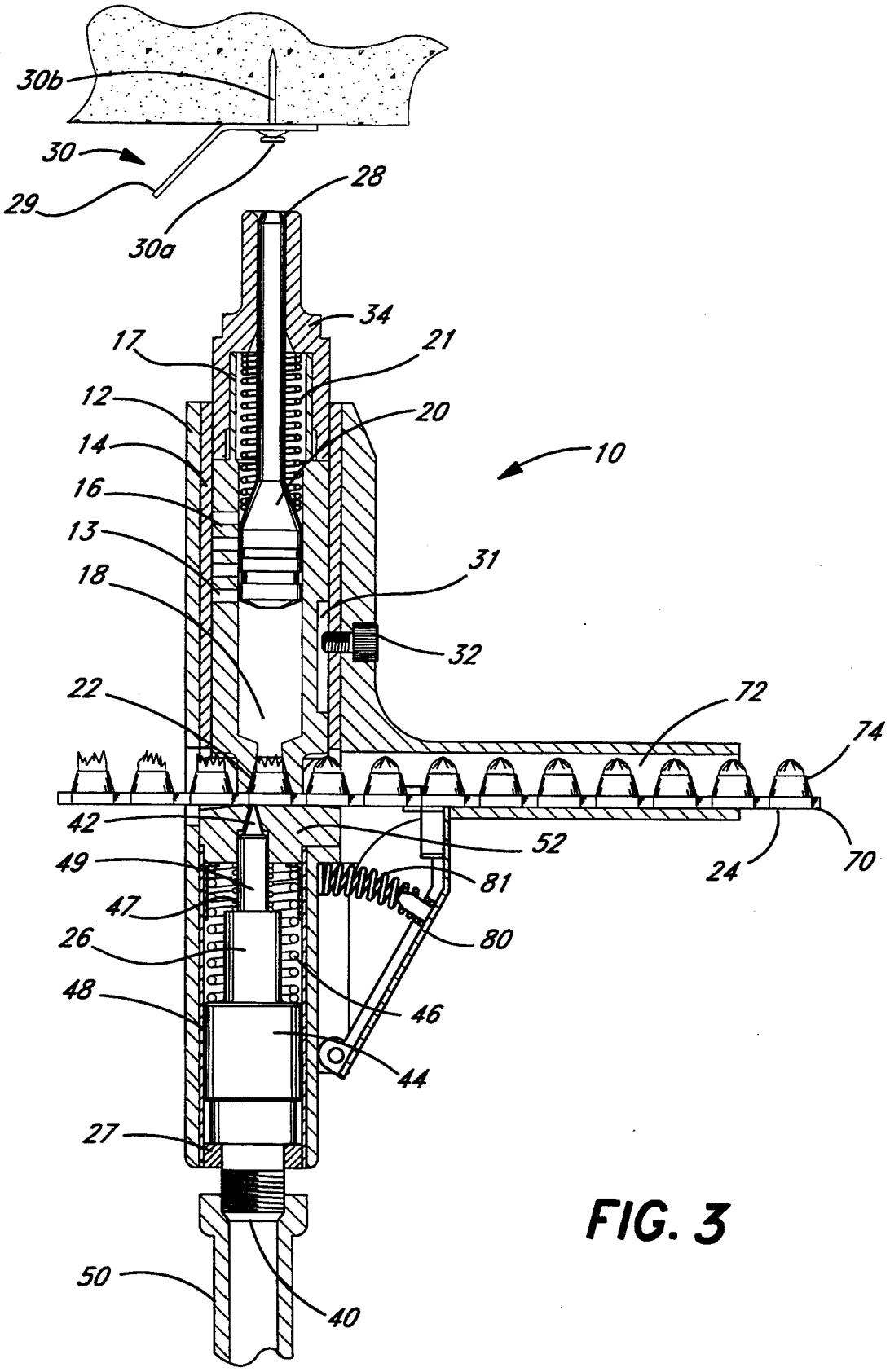
FIG. 3 is a longitudinal sectional view of the tool already fired with the piston shown in an extended firing position.

FIGS. 1 and 2 show the piston 20 at its resting position. Piston 20 is a "free floating" piston. That is, it has lands which guide piston 20 within the barrel bore, but it does not include rings in the grooves between the lands to frictionally seal the piston. In view of the essentially closed chamber behind piston 20, it has been found unnecessary to add sealing piston rings to tool 10. This lowers production and maintenance costs. Piston 20 is positioned within the bore of barrel 16 such that it can axially slide within the bore. If desired, a biasing means, such as a spring 21, can be associated with piston 20 to retract it to the orientations shown in FIG. 1, after the firing of tool 10.

A plurality of ports 13 formed in barrel 16 define chambers which allow the combustion gases to expand. Although ports 13 are apertures which pass completely through barrel 16, they are closed at their outer ends by sleeve 14, thus in effect forming blind expansion chambers. This expansion aids in muffling the noise generated by cartridges 24 by lessening the acoustic energy of the gases. The size and location of ports 13 are selected to "tune" the enclosed bore and chambers such that reflections of acoustic waves tend to cancel each other, further reducing the noise emitted by tool 10. The location of the first or most rearward port is such that when a fastener 30 is properly spaced by the nosepiece 34, the high velocity gases are not permitted to expand until fastener 30 is completely driven into the workpiece. Specifically, the first port is positioned at a location in the barrel adjacent to that of the rear of piston 20 when a standard 1¼-inch fastener is completely driven into the workpiece. An improvement in driving force is achieved since there is no exit means for the expanding gases of the propellant and, thus, no drop in the driving force being applied to the fastener until after the fastener is fully seated in the workpiece. A very small portion of the spent combustion gases will be forced by the internal pressure caused by the cartridge explosion to escape into the annular space between sleeve 14 and barrel 16 due to the two being loosely enough fitted so as to be slidable relative to each other, but the majority of the gases exit through breech 18 after barrel 16 is returned to the quiescent state shown in FIG. 1. The "annular space" is not a passageway, but simply a mechanical clearance of the minimal tolerance required to permit barrel 16 to freely slide axially within sleeve 14. There are no passages provided into or through sleeve 14 and/or housing 12 for the purpose of permitting the combustion gases to exit the bore of barrel 16 and be discharged into the atmosphere through housing 12 or sleeve 14.

A nosepiece 34, having a bore extending therethrough, is removably attached to the front of barrel 16, such as by being threadedly engaged therewith. Nosepiece 34 has a forward end in the firing direction which defines a muzzle 28 and a rear end in the opposite direction which is preferably threaded (not shown) to engage barrel 16. The bore in the rear portion of nosepiece 34 is sized to fit on the external surface of an extension 17 of barrel 16. The bore on the muzzle end 28 of nosepiece 34 is sized for receiving a fastener 30 to be driven by the tool and secured in a work surface such as a ceiling or the like. The external diameter of nosepiece 34 is slidably received within sleeve 14; compare FIGS. 1 and 2. The length of nosepiece 34 is sized to the length of fastener 30 and a plurality of nosepieces of differing lengths may be interchangeable to accommodate a variety of fastener lengths. Nosepiece 34 is properly sized to a particular fastener 30 when it maintains the integrity of contact between the breech, the piston, and the fastener prior to and at firing of the tool. Preferably, the rear of fastener 30 and the tip of piston 20 are in direct contact without spaces between them, however, slight variations in machining tolerances or improper placement of the fastener by the operator may result in a small, but negligible gap when the tool 10 is in a quiescent state.

Firing pin 26 is mounted within the rear end of the housing bore which is lined with a rear barrel liner 48. Firing pin 26 is of a predetermined length with a threaded shank portion 40, a conical firing pin tip 42, and a flange 44 that acts as a shoulder for a biasing spring 46. Firing pin 26 is inserted through an access hole in the back of rear barrel liner 48. Firing pin 26 is mounted such that it can slide axially with limited longitudinal movement relative to housing 12. A second biasing spring 47 surrounding the nose 49 of firing pin 26 urges firing pin 26 rearwardly towards the back end of housing 12. This biasing functions as a safety feature to prevent tool discharge, since the tool cannot discharge unless handle 50 and thus firing pin 26 is axially displaced against cartridge 24 in breech end 18. Sufficient displacement of handle 50 and firing pin 26 would normally occur when the tool is impacted against a ceiling. A retaining ring 27 is threadedly engaged to the rear of the tool housing to retain the firing pin. The threaded shank portion of firing pin 26 extends through ring 27 and out of the back end of the tool.

The tool includes an elongated extension handle 50, preferably an axially elongated tube adapted to be grasped at one end by an operator. The opposite end of handle 50 is threadedly engaged to shank portion 40 of firing pin 26, thus handle 50 operates as a slidable ram for firing an explosive charge contained within cartridge 24. As hereinafter described, handle 50 is pushed inwardly to ignite cartridge 24 to propel piston 20 to drive fastener 30 out of muzzle 28 and into the work surface.

The tool utilizes an industry-standard, multicartridge, magazine strip 70 to propel piston 20 to muzzle end 28 of barrel 16 forcing fastener 30 into the receiving substrate. The disposable magazine strip 70, preferably fabricated of a resilient material such as plastic, is provided with a plurality of tubular projections 74 defining cartridge receiving recesses. Cartridges 24 are held in the magazine within the recesses so that the forward tips project outwardly in a direction toward barrel 16 and they are successively aligned with barrel 16 for successive firing. Typically, ten cartridges in a plastic strip are manually guided into a tool magazine channel 72 until the first load enters firing chamber 22. The tool housing defines the magazine channel 72 which extends at substantially right angles to the movement and direction of barrel 16. A manually operated indexing lever 80 is pivotally mounted to tool housing 12 and compresses a fulcrum spring 81 that regulates its travel distance. The spring resistance is overcome with a hand squeeze to depress lever 80 and upon release, lever 80 returns to a disengaged position.

Indexing lever 80 includes an angularly-shaped tip 82 which engages the side serrations on multiload strip 70 to advance a new cartridge 24 into place, aligning it with breech 18 and simultaneously removing the spent cartridge away from firing chamber 22.

The cartridge magazine strip 70, a plastic band with apertures for retaining cartridges, abuts against breech 18. In the forward direction, tubular projection 74 surrounds each cartridge 24. The base of the band provides a sealing engagement with breech 18. The plastic band of the cartridge magazine forms a necessary wall portion of the closed firing chamber 22 to provide a gas seal upon explosion of cartridge 24 and during the initial forward movement of drive piston 20 therein.

As best shown in FIG. 2, in operation, a fastener 30 is placed into nosepiece 34 of barrel 16. Preferably, head **30*a* of fastener 30 is in cylindrically sealing relation to the circumference of the bore. Upon insertion, fastener 30 is placed in the bore of muzzle 28 into contact with the end of piston 20, if piston 20 is biased into a retracted position. If piston 20 is unbiased, head 30*a* of the fastener 30 pushes the captive piston 20 backward to its reset position in bore-sealing relationship with breech 18 at the rear of the barrel. This single step eliminates a number of positioning steps required in some of the prior art. Normally, when completely inserted, the tip of shank portion 30*b* of fastener 30 extends outwardly of the end of muzzle 28. In the reset position, fastener 30, piston 20, and the rear of barrel 16 are in direct contact without spaces or gaps between each element. The tool is made ready to fire by manually indexing a cartridge 24** into the firing position.

The tool is fired by an operator pushing the tool by its handle to press fastener 30 protruding from the end of nosepiece 34 against a dense ceiling substrate with sufficient force to depress nosepiece 34 rearward; see FIG. 2. As nosepiece 34 is depressed, barrel 16 is likewise urged rearward such that breech 18 at the rear of barrel 16 is seated onto cartridge 24. At this point, strip 70 is in sealing relationship between the rearward edge of barrel 16 and a breech block 52 friction fit into housing 12 and liner 48. Breech block 52 includes a conical aperture for receiving tip 42 of firing pin 26. Thus, the combustive gases of cartridge 24 have no place to go but into the bore of barrel 16. Simultaneously, as momentum continues to push handle 50 inwardly towards muzzle end 28 of the driving tool, firing pin 26 is urged into contact with the rear of cartridge 24. In consequence, conical tip 42 of firing pin 26 is forced against cartridge 24 with sufficient force to detonate cartridge 24. At the moment of detonation, every active element of the tool is in direct linear contact with every other active element and the momentum of the tool is in the firing direction. Having all of the surrounding structures in substantially solid contact further aids in muffling the noise of the cartridge explosion.

Under the force of the explosive charge, piston 20 is rapidly driven forward, driving fastener 30 positioned in nosepiece 34 into the receiving substrate. See FIG. 3. The fastener's driving momentum is assisted by the user's bumping motion against the work surface, thus enabling cartridge 24, piston 20 and fastener 30 to move simultaneously in the impact direction. As a result of the tool elements being in direct linear contact, the entire explosive power of cartridge 24 is utilized to drive fastener 30 into the receiving substrate. Thus, this tool achieves superior driving force over much of the prior art.

Once piston 20 has driven fastener 30 into the receiving substrate, the barrel biasing means 25 returns barrel 16 to its forward position, moving breech 18 away from cartridge 24, allowing the spent combustion gases to exit the tool around cartridges 24 and through magazine channel 72 into the atmosphere. At the same time biasing springs 46 and 47 return firing pin 26 to its rearward position. The tool is ready for use again and the process is repeated by inserting a new fastener 30 into nosepiece 34, resetting piston 20 if necessary, and then manually indexing a new cartridge into the firing position.

Figure 4:
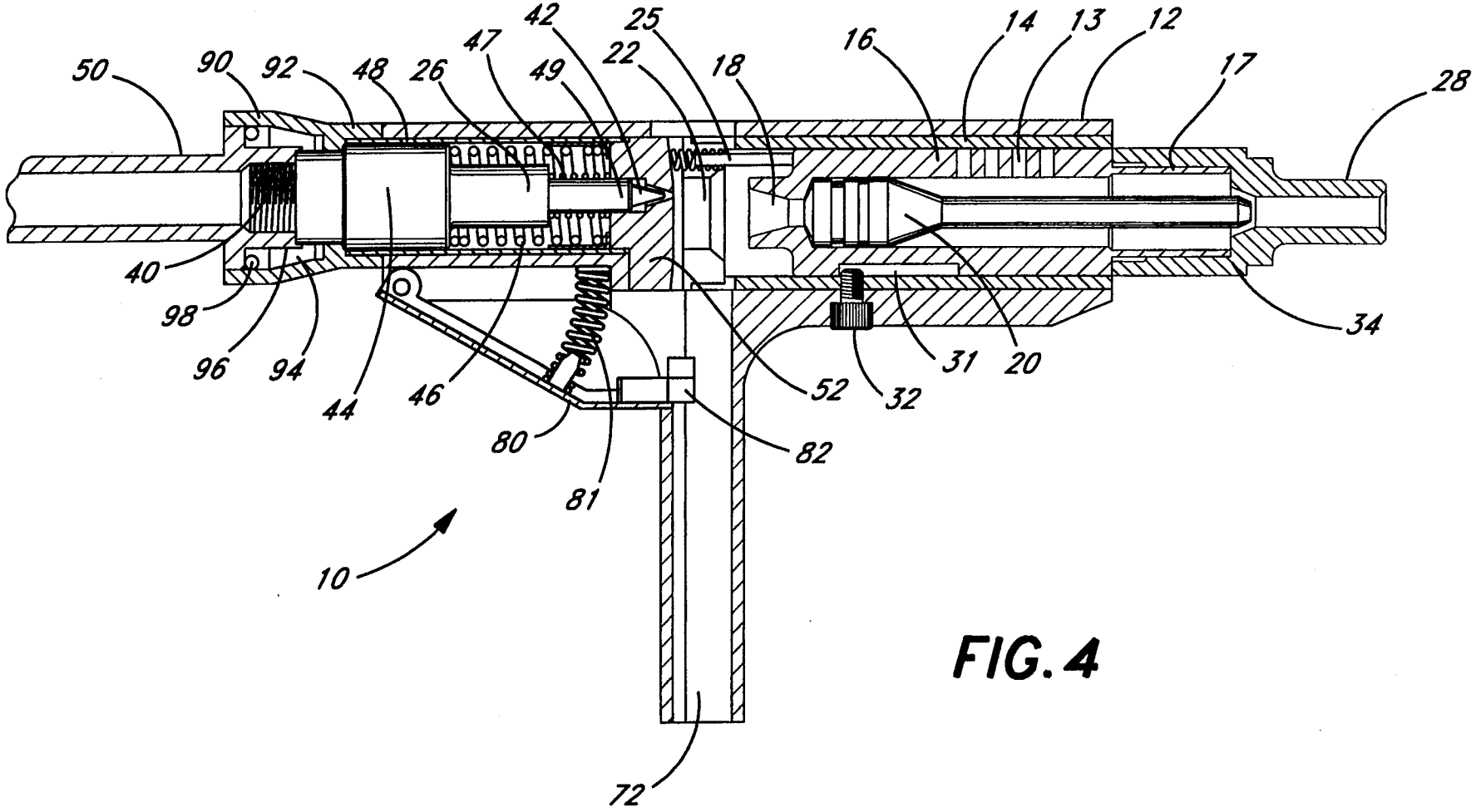
FIG. 4 is a longitudinal sectional view of a second embodiment of the tool with a ball lock safety device.

A second embodiment of tool 10 is shown in FIG. 4 and includes a ball lock safety device 90 to allow discharge only when muzzle 28 of the tool is pointed in an upwardly inclined direction. Safety device 90 comprises a member 92 having a bore therethrough mounted to the rear of the housing. One end of handle 50 is threadedly engaged to shank portion 40 of firing pin 26 which extends through safety device 90. When engaged with firing pin shank 40, handle 50 forms a substantially longitudinal internal groove 94 with a shoulder 96 within the safety device. A metal ball 98 has freedom to move within groove 94 and will move to the rear of groove 94 when the tool 10 is pointed upward and will move to the front of groove 94 when tool 10 is pointed in a downward direction. Ball 98 is sized to lodge between shoulder 96 and the wall of the groove and thus block the axial movement of handle 50 when the tool is pointed downward. This blocking of movement prevents discharge when the tool is pointed downward, yet permits discharge when the tool is pointed upward, as is normal when firing fasteners 30 into a ceiling.

The tool provides an inherently safe structure combining three safety features to prevent accidental discharge. All three safety features must cooperate before discharge of tool 10 is permitted: (1) barrel biasing means 25 requires that muzzle 28 be axially displaced against the biasing means by pressing fastener 30 against a surface to effect displacement of muzzle 28; (2) the impact with the surface must be sufficient to axially displace and drive firing pin 26 forward to ignite cartridge 24; and (3) muzzle 28 must be pointed upward, otherwise safety ball lock 90 will prevent discharge of tool 10.

A third embodiment of the invention is shown in FIGS. 5–8. This embodiment differs from the second embodiment in the mechanism for constraining barrel 16 to limited longitudinal movement and in the provision of a cocking and firing mechanism for the firing pin. The reference numerals refer to corresponding elements as in the previous embodiment.

The piston end of tool 10 includes housing 12, sleeve 14, barrel 16, nosepiece 34, and piston 20; all are related as above. Barrel 16 is provided with ports 13, breech 18, and slot 31. A spring 23 biases barrel 16 forwardly, removing breech 18 from the firing chamber 22. Instead of screw 32 having a tip located within slot 31, as in FIG. 1, the constraining mechanism comprises a wedge 33 held in slot 31 by spring 35 and a screw 36 threaded into a press-fit cylinder 37. As wedge 33 is worn by continuous use of tool 10, it can easily be replaced by removing screw 36, spring 35, and the worn wedge, and inserting a new wedge.

Figure 5:
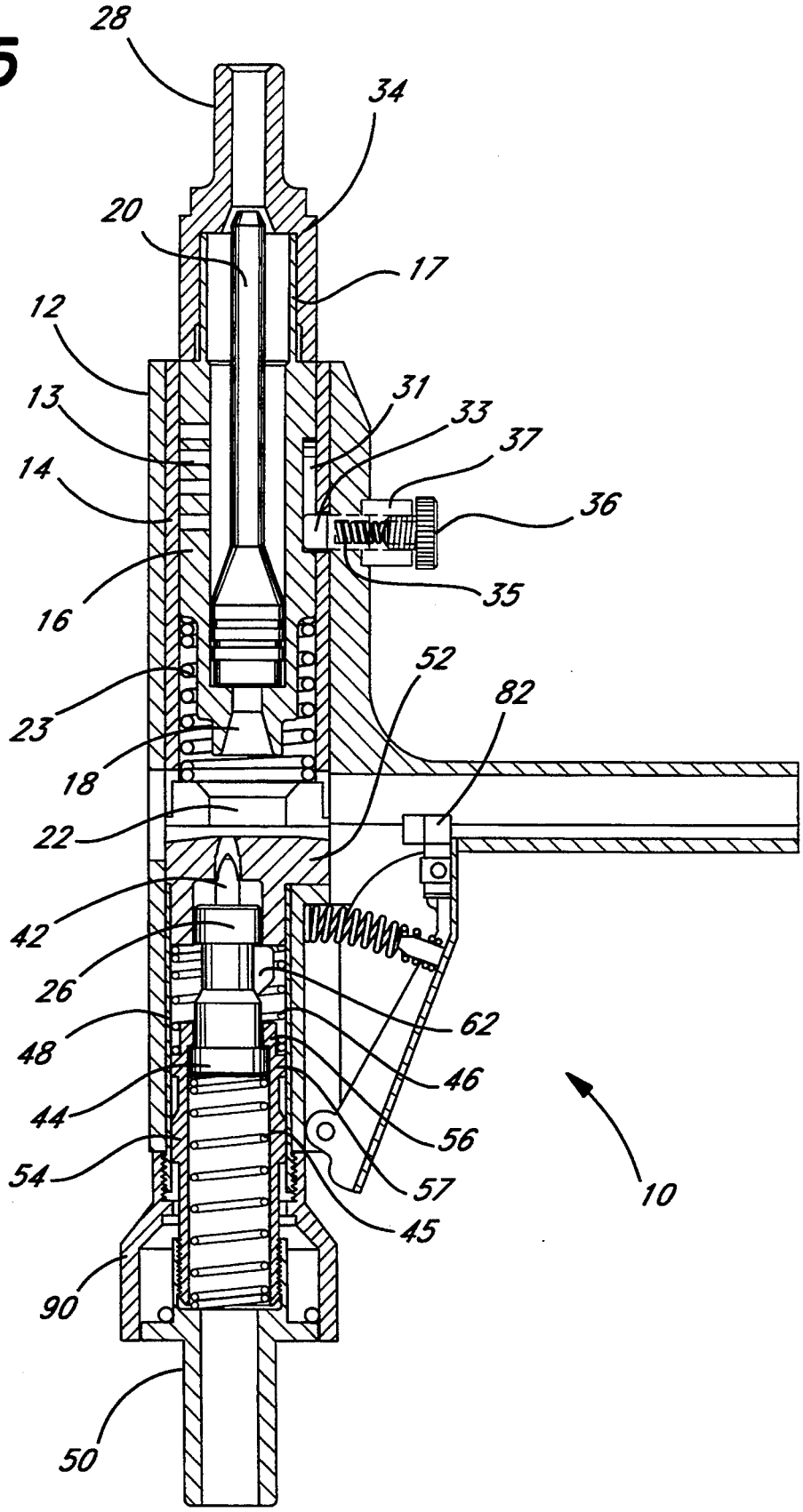
FIG. 5 is a longitudinal sectional view of a third embodiment of the tool in a quiescent state.
Figure 6:
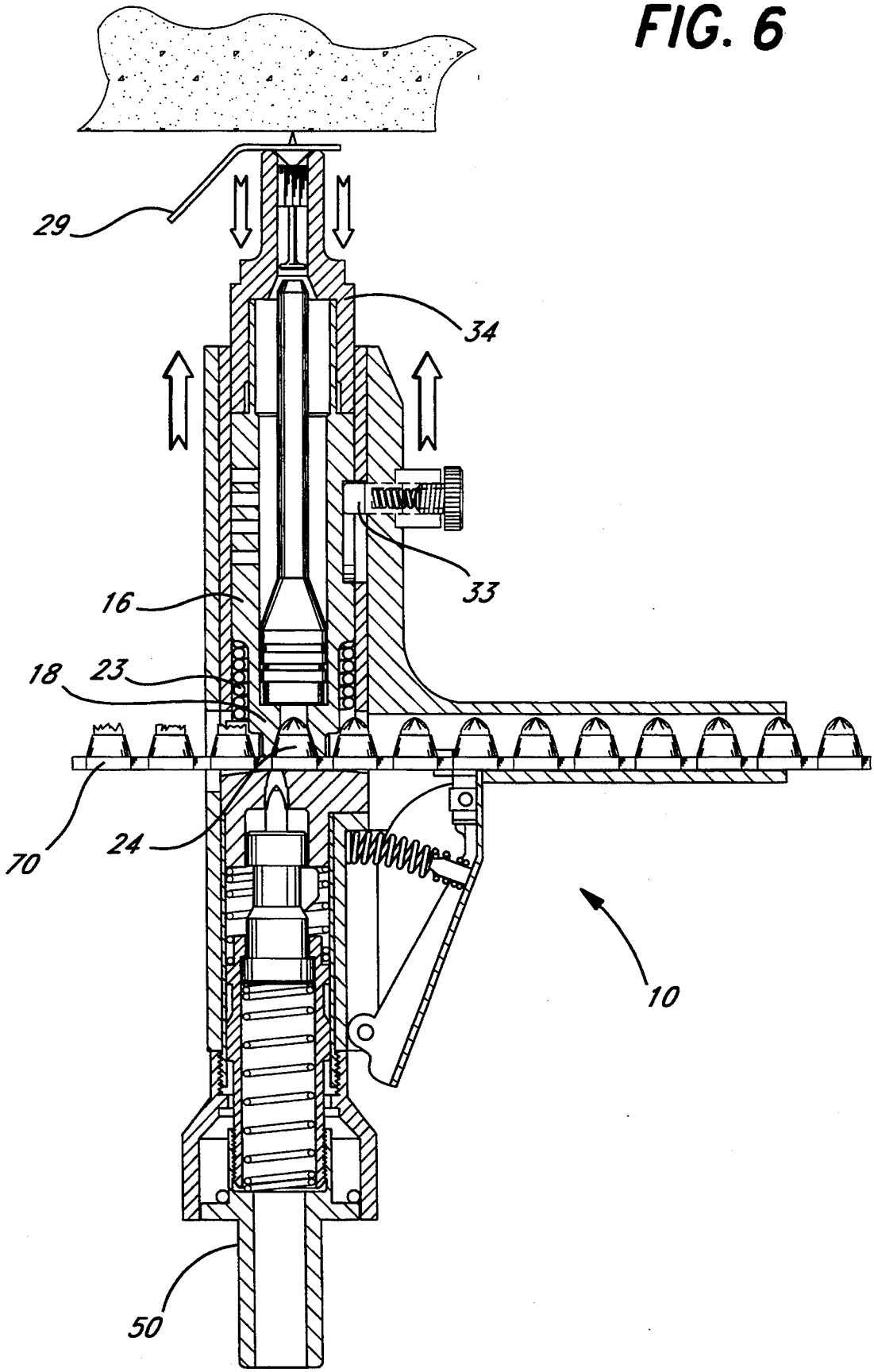
FIG. 6 is a longitudinal sectional view of the third embodiment, loaded with a cartridge and ready to fire, showing the first step in firing the tool.

The firing pin end of tool 10 includes housing 12, liner 48, and safety device 90, as in the previous embodiments, but differs in the firing mechanism. Handle 50 is threadedly engaged with the rear end of sleeve 54 which has an internal bore sized to slidably receive a flange 44 on the rear end of firing pin 26. A cocking spring 45 seats between an internal shoulder in handle 50 and the back face of firing pin 26. A return spring 46 seats between breech block 52 and an annular land 57 of sleeve 54. An inwardly directed flange 56 on sleeve 54 provides a shoulder for a mating shoulder on flange 44 of firing pin 26. Flange 44 is biased into firm contact with flange 56 by cocking spring 45, when tool 10 is in its quiescent state, as shown in FIG. 5. When the operator releases the pressure on handle 50 and return spring 46 restores sleeve 54 to its rest position, flange 56 retracts firing pin 26 away from magazine strip 70 (FIG. 6).

Figure 7A:
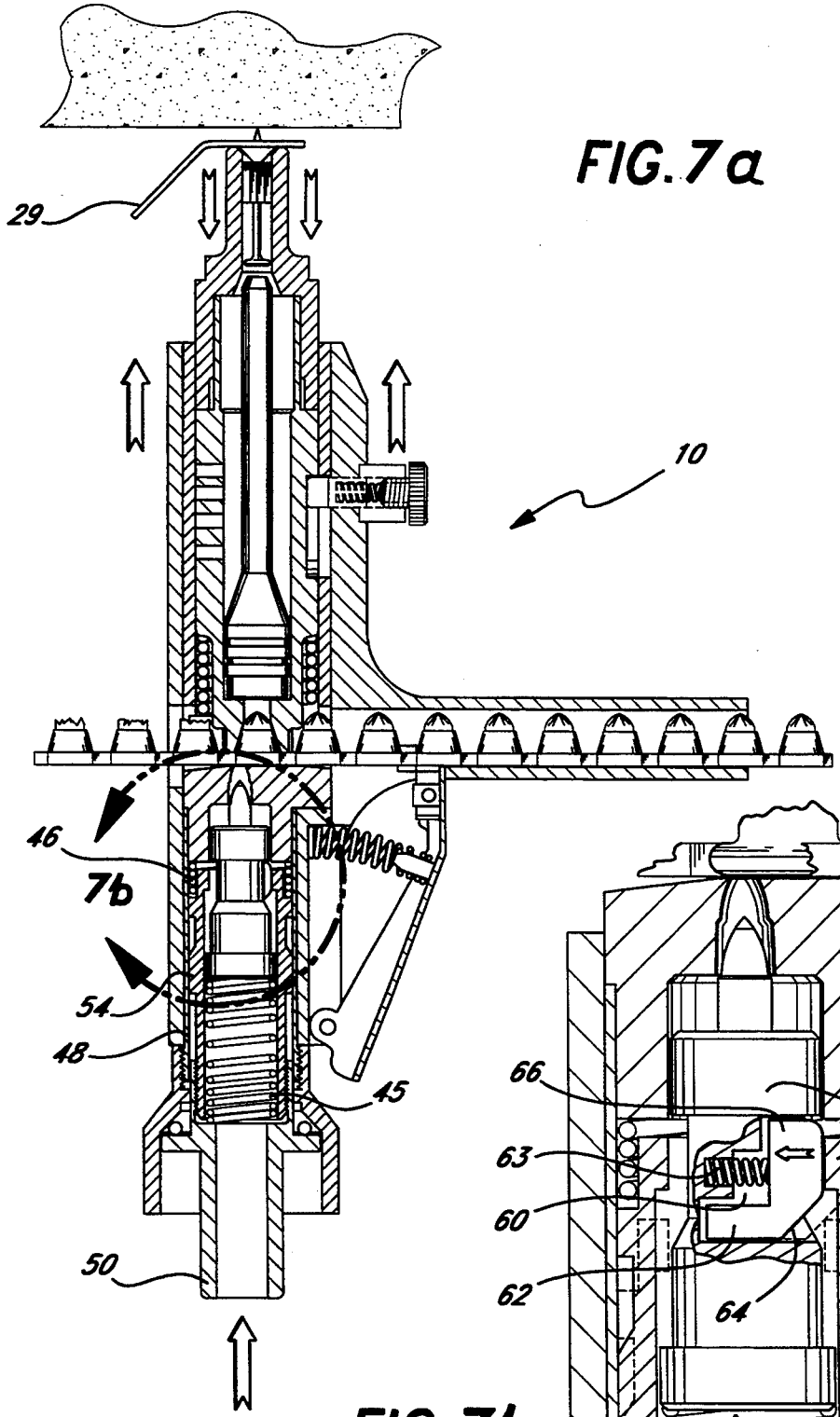
Figure 7B:
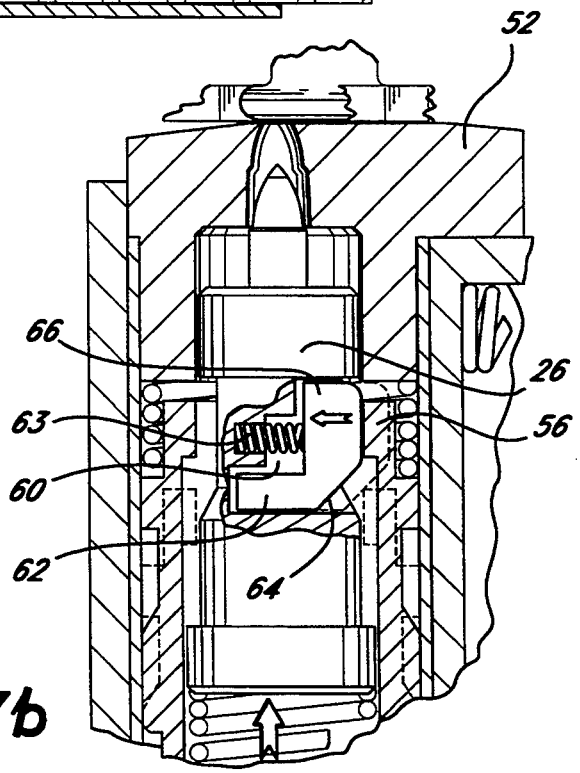

As best seen in FIGS. 7*b* and 8*b*, firing pin 26 has a radially extending slot 60 within which a J-shaped actuator pawl or sear 62 slides. Sear 62 has an upwardly, rearwardly sloping cam surface 64 and a transverse, forwardly located surface 66. Spring 63 biases sear 62 outwardly transversely away from the longitudinal axis of firing pin 26.

The operation of the firing mechanism will now be described, referring sequentially to FIGS. 5–8.

FIG. 5 shows the quiescent state of tool 10. Barrel 16 is forwardly biased by spring 23 so that wedge 33 is in contact with the rear edge of slot 31 and breech 18 is outside of firing chamber 22. Cocking spring 45 seats flange 44 of firing pin 26 against flange 56 of sleeve 54. Return spring 46 biases sleeve 54 toward the rear, thus spacing firing pin 26 away from plug 52. Spring 63 biases sear 62 away from the axis of firing pin 26 and surface 66 rests against the base of breech block 52, also preventing firing pin 26 from moving forwardly. Tool 10 is ready for insertion of magazine strip 70.

FIG. 6 shows tool 10 after initial pressure has been applied by the operator via handle 50. Spring 23 has been compressed by barrel 16 by nosepiece 34 sliding rearwardly until stopped by wedge 33. Breech 18 is forced into firing chamber 22, over cartridge 24, and into sealing relationship with the plastic strip of magazine strip 70.

In FIG. 7*a*, tool 10 is shown just prior to firing. Handle 50 has slid sleeve 54 forwardly within liner 48, compressing both cocking spring 45 and return spring 46. Until now transverse surface 66 of sear 62, being in contact with the base of breech block 52, has prevented firing pin 26 from moving forwardly. The corner of flange 56 has come into contact with sloping surface 64 of sear 62, as shown in dashed lines in FIG. 7*b*, and has forced sear 62 in the direction of the arrow to the solid line position. In the position shown in FIGS. 7*a* and 7*b*, sear 62 no longer restrains firing pin 26. In the next instant, cocking spring 45 will release the energy stored therein by thrusting firing pin 26 rapidly forwardly.

FIGS. 8*a* and 8*b* show the situation just after the firing pin has impacted the cartridge. The continued pressure applied by the operator on handle 50 maintains all the active elements in direct contact with each other. Sleeve 54 has compressed return spring 46 to its maximum compression; breech block 52 is in firm contact with the back of strip 70; spring 23 is fully compressed; breech 18 remains in sealing contact with strip 70; and nosepiece 34 is in solid contact with the fastener-receiving substrate. Only the internal elements have moved. Cocking spring 45 has impelled firing pin 26 into detonating impact with cartridge 24, and the exploding gases have forcibly driven piston 20, and thereby fastener 30, forwardly. FIG. 8*b* shows sear 62 within a bore in breech block 52 and the tip of firing pin 26 in contact with cartridge 24.

As the gases continue to expand, piston 20 will extend beyond muzzle 28, forcing tool 10 away from the substrate and permitting the gases to expand into ports 13, diminishing the noise produced by the explosion. Tool 10 will recoil away from the substrate. Spring 23 will expand, forcing barrel 16 forwardly, thereby retracting breech 18 from strip 70, and permitting the expended gases to escape through firing chamber 22 to the atmosphere. Return spring 46 will return sleeve 54 to its retracted position, thereby retracting firing pin 26, also. Tool 10 is again in its quiescent state.

Insertion of a new fastener and manual actuation of indexing lever 80 to move the next cartridge into the firing chamber will ready the tool for its next firing.

The disclosed tool has fulfilled its objects. The tool evidences low noise, because the explosive gases are confined within the tool by an essentially solid surrounding structure and the explosion chamber is tuned to cancel internal acoustic waves. The tool has few parts, relative to many prior art impact tools, so it is easy to assemble and simple and reliable to manufacture and maintain.

While the invention has been particularly shown and described with reference to a preferred embodiment thereof, it will be understood by those skilled in the art that various changes in form and details may be made therein without departing from the spirit and scope of the invention. It is intended that all matter contained in the above description and depicted in the accompanying drawings be construed in an illustrative and not in a limiting sense.

What is claimed is:

1. In an explosive actuated tool for driving a fastener into a workpiece, a firing mechanism comprising:

a housing having a longitudinal bore extending therethrough, one end of said bore facing in the driving direction of said tool;

a breech block affixed to said housing bore at said one end;

a sleeve slidable longitudinally within said housing bore;

a firing pin slidable longitudinally within said sleeve and through said breech block;

a return spring biasing said sleeve and said firing pin longitudinally away from said one end;

a cocking spring within said sleeve for biasing the firing pin longitudinally toward said one end;

means for preventing said firing pin from exiting the end of said sleeve facing said one end;

handle means for moving said sleeve longitudinally within said housing bore, compressing both said return and said cocking springs;

sear means for preventing movement of said firing pin toward said breech block during the compression of said return and cocking springs; and means on said sleeve for contacting said sear means near the end of the compression of said return and cocking springs as said sleeve is moved longitudinally within said housing bore, thereby releasing said sear means from preventing movement of said firing pin and permitting said cocking spring to impel said firing pin forcibly into said breech block.

2. The firing mechanism of claim 1 wherein said breech block includes an internal bore partially extending through said breech block and a passage extending from said breech block bore through the remainder of said breech block into a firing chamber, and said firing pin includes a tip shaped to fit within and through said passage and a flange shaped to slidably fit within said breech block bore but not within said passage.

3. The firing mechanism of claim 1 wherein said breech block further includes a shoulder extending transversely of said housing bore, and said sear means has a transverse surface which abuts said transverse shoulder until moved out of contact therewith by said sleeve.

4. The firing mechanism of claim 3 wherein said firing pin includes a radially extending slot and said sear means comprises a pawl slidable in said slot and a spring for biasing said pawl radially outwardly from the longitudinal axis of said firing pin, said pawl including a cam surface which coacts with an edge of said sleeve to cam said pawl into said slot, whereupon said transverse surface of said sear means moves out of contact with said breech block transverse shoulder.

5. The firing mechanism of claim 2 wherein said housing bore, said handle, said sleeve, said firing pin, and said breech block bore and passage are all coaxially aligned.

6. A tool as in claim 1 wherein said means for preventing said firing pin from exiting the end of said sleeve comprises a radially outwardly directed flange on said firing pin and a radially inwardly flange at the end of said sleeve facing said forward end, said flanges presenting confronting shoulders which are biased into contact by said cocking spring.

7. A tool as in claim 1 further comprising:

a barrel slidably mounted within the housing; and a piston slidably mounted within the barrel, wherein a biasing means operationally associated with the piston returns the piston to its resting orientation after firing the tool.

8. A tool as in claim 7 wherein a plurality of apertures are formed in said barrel, said apertures being substantially closed at their outer ends by said housing to form chambers which allow the combustion gases to expand into the said expansion chambers.

9. A tool as in claim 1 further comprising a safety means to prevent axial movement of the firing pin when the muzzle of the tool is oriented in a downward direction.

10. An explosive actuated tool for driving a fastener into a workpiece comprising:

a housing having first and second longitudinal bores therein separated by a firing chamber, said first bore being at a forward end of said tool and said second bore being at a rearward end of said tool;

a barrel slidably received in said first bore, said barrel having a muzzle at one end for receiving said fastener and a breech at the other end, said breech end being adjacent to said firing chamber;

means for biasing said barrel away from said firing chamber;

a blind slot in the external surface of said barrel;

means insertable through said housing and into said slot for limiting movement of said barrel in said housing;

strip means for carrying a plurality of cartridges;

means for holding, guiding and indexing said strip means into said firing chamber such that the cartridges are sequentially fed into alignment with said barrel breech;

a firing mechanism in said second bore, said firing mechanism comprising:

a breech block affixed to said second bore adjacent said firing chamber;

a sleeve slidable longitudinally within said second bore;

a firing pin slidable longitudinally within said sleeve and through said breech block;

a return spring biasing said sleeve and said firing pin longitudinally toward said tool rearward end;

a cocking spring within said sleeve for biasing the firing pin longitudinally toward said tool forward end;

means for preventing said firing pin from exiting the end of said sleeve facing said forward end;

handle means for moving said sleeve longitudinally within said second bore, compressing both said return and said cocking springs, said handle means extending from the rearward end of said tool;

sear means for preventing movement of said firing pin toward said breech block during the compression of said return and cocking springs; and means on said sleeve for contacting said sear means near the end of the compression of said return and cocking springs as said sleeve is moved longitudinally within said housing bore, thereby releasing said sear means from preventing movement of said firing pin and permitting said cocking spring to impel said firing pin forcibly into said breech block.

11. The tool of claim 10 wherein said breech block includes an internal bore partially extending through said breech block and a passage extending from said breech block bore through the remainder of said breech block into said firing chamber, and said firing pin includes a tip shaped to fit within and through said passage and a flange shaped to slidably fit within said breech block bore but not within said passage.

12. The tool of claim 10 wherein said breech block further includes a shoulder extending transversely of said housing bore, and said sear means has a transverse surface which abuts said transverse shoulder until moved out of contact therewith by said sleeve.

13. The tool of claim 12 wherein said firing pin includes a radially extending slot and said sear means comprises a pawl slidable in said slot and a spring for biasing said pawl radially outwardly from the longitudinal axis of said firing pin, said pawl including a cam surface which coacts with an edge of said sleeve to cam said pawl into said slot, whereupon said transverse surface of said sear means moves out of contact with said breech block transverse shoulder.

14. The tool of claim 11 wherein said second bore, said handle, said sleeve, said firing pin, and said breech block bore and passage are all coaxially aligned.

15. The tool of claim 10 wherein said limiting means comprises a wedge, said wedge being biased by a spring into said slot, and said wedge and said wedge biasing spring being confined within an aperture in said housing by a threaded screw.

16. A tool as in claim 10 wherein said means for preventing said firing pin from exiting the end of said sleeve comprises a radially outwardly directed flange on said firing pin and a radially inwardly flange at the end of said sleeve facing said forward end, said flanges presenting confronting shoulders which are biased into contact by said cocking spring.

17. A tool as in claim 10 wherein a plurality of apertures are formed in said barrel, said apertures being substantially closed at their outer ends by said housing to form chambers which allow the combustion gases to expand into the said expansion chambers.

18. A tool as in claim 17 wherein the apertures are sized and selectively located such that the most rearward aperture is at a location wherein said combustion gases are not permitted to expand thereinto until the fastener is completely driven into the workpiece.

19. A tool as in claim 17 wherein the apertures are sized and selectively located such that the apertures reflect acoustic waves in order to reduce noise emitted by the tool.

20. A tool as in claim 10 further comprising a safety means to prevent axial movement of the firing pin when the muzzle of the tool is oriented in a downward direction.

21. An explosive actuated tool for driving a fastener into a workpiece comprising:

a housing having first and second longitudinal bores therein separated by a firing chamber, said first bore being at a forward end of said tool and said second bore being at a rearward end of said tool;

a barrel slidably received in said first bore, said barrel having a muzzle at one end for receiving said fastener and a breech at the other end, said breech end being adjacent to said firing chamber;

means for biasing said barrel away from said firing chamber;

a blind slot in the external surface of said barrel;

means insertable through said housing and into said slot for limiting movement of said barrel in said housing;

strip means for carrying a plurality of cartridges;

means for holding, guiding and indexing said strip means into said firing chamber such that the cartridges are sequentially fed into alignment with said barrel breech;

a firing mechanism in said second bore, said firing mechanism comprising:

a sleeve slidable longitudinally within said second bore;

a firing pin slidable longitudinally within said sleeve;

a return spring biasing said firing pin longitudinally toward said tool rearward end;

a cocking spring within said sleeve for biasing the firing pin longitudinally toward said tool forward end; handle means for moving said sleeve longitudinally within said second bore, compressing both said return and said cocking springs, said handle means extending from the rearward end of said tool;

sear means for preventing movement of said firing pin toward said tool forward end during compression of said return and compression springs; and means on said sleeve for contacting said sear means near the end of the compression of said return and said cocking springs as said sleeve is moved longitudinally within said housing bore, thereby releasing said sear means from preventing movement of said firing pin and permitting said firing pin to move toward said tool forward end.

22. A tool as in claim 21 wherein a plurality of apertures are formed in said barrel, said apertures being substantially closed at their outer ends by said housing to form chambers which allow the combustion gases to expand into the said expansion chambers.

23. A tool as in claim 22 wherein the apertures are sized and selectively located such that the most rearward aperture is at a location wherein said combustion gases are not permitted to expand thereinto until the fastener is completely driven into the workpiece.

24. A tool as in claim 22 wherein the apertures are sized and selectively located such that the apertures reflect acoustic waves in order to reduce noise emitted by the tool.

25. A tool as in claim 21 further comprising a means to prevent axial movement of the firing pin when the muzzle of the tool is oriented in a downward direction.

* * * * *